US006932152B2

(12) United States Patent
Iwasaki et al.

(10) Patent No.: US 6,932,152 B2
(45) Date of Patent: Aug. 23, 2005

(54) CORE STRUCTURE OF HEAT EXCHANGER

(75) Inventors: Mitsuru Iwasaki, Nakano-Ku (JP); Shinobu Asakawa, Nakanu-ku (JP); Daisuke Matsuda, Nakanu-ku (JP); Shouji Tasaka, Nakanu-ku (JP); Toshinobu Imamura, Nakanu-ku (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/806,321

(22) Filed: Mar. 23, 2004

(65) Prior Publication Data

US 2004/0226693 A1 Nov. 18, 2004

(30) Foreign Application Priority Data

Mar. 24, 2003 (JP) ..... 2003-080618

(51) Int. Cl.[7] ..... F28F 9/02
(52) U.S. Cl. ..... 165/83; 165/173
(58) Field of Search ..... 165/81, 83, 173, 165/175

(56) References Cited

U.S. PATENT DOCUMENTS 2,807,445 A * 9/1957 Gardner ..... 165/173
4,582,127 A * 4/1986 Moranne ..... 165/83
4,702,079 A * 10/1987 Saito et al. ..... 60/599
4,881,594 A * 11/1989 Beamer et al. ..... 165/173
5,664,625 A * 9/1997 Letrange et al. ..... 165/173
5,676,200 A * 10/1997 Laveran ..... 165/83
6,082,439 A * 7/2000 Kato et al. ..... 165/79
6,651,333 B2 * 11/2003 Letrange et al. ..... 29/890.052

* cited by examiner

*Primary Examiner*—Allen J. Flanigan
(74) *Attorney, Agent, or Firm*—Wenderoth, Lind & Ponack, L.L.P.

(57) ABSTRACT

In a core structure of a heat exchanger, tubes and corrugated fins are alternately arranged between seat plates arranged opposite to each other with a predetermined space interposed therebetween. Both end portions of the tubes are inserted into tube holes of connection portions formed respectively in each of the top and bottom seat plates to be fixed. On the seat plates, there are provided connection portions on which are formed wall portions slanting from main body portions thereof toward the tubes and vulnerable portions formed thinner than the seat plates and in series on the wall portions and absorb thermal stress of the seat plates against the tubes by bending.

2 Claims, 13 Drawing Sheets

CORE STRUCTURE OF HEAT EXCHANGER

BACKGROUND OF THE INVENTION

1. Field of the Invention

The present invention relates to a core structure of a heat exchanger having tubes through which a heat exchange medium flows being fixed to seat plates and corrugated fins radiating heat of the heat exchange medium through the tube, especially the core structure used for a heat exchanger such as a radiator for a motor vehicle or the like.

2. Description of the Related Art

A conventional core structure of a heat exchanger is, for example, disclosed in Japanese Patent Laid-open No. Tokkaihei 11-14285 and in Japanese Patent Laid-open No. Tokkaihei 9-318292. These conventional core structures of the heat exchangers have structures in which both edge portions of seat plates arranged opposite to each other are coupled by reinforcements.

FIG. 8 shows an example of the conventional core structure of the heat exchanger, in which tubes 102 and corrugated fins 103 are arranged alternately between seat plates 101 arranged opposite to each other with a predetermined space interposed therebetween, and both edge portions of the seat plates 101 are coupled and reinforced by reinforcements 104.

On the seat plates 101, as shown in FIG. 9, tube holes 105 for fixing the tubes 102 by insertion and connection portions 106 having wall portions with tube holes 105 projecting to extend along the tubes 102 are formed by burring.

However, in the conventional core structure of the heat exchanger, when coolant flowing from an engine into a radiator rapidly changes in temperature from low to high, large thermal expansion of the tubes 102 and the seat plates 101 occurs, which may cause the connection portions 106 to press the tubes 102 to crack and/or break root portions of the tubes 102.

Incidentally, the rapid change of coolant flowing from the engine into the radiator in temperature from low to high occurs, for example, in a case that when the engine is started in a cold region, coolant of the engine increases gradually in temperature but does not flow into the radiator until it reaches a valve-opening temperature of a thermostat, and then the temperature of the coolant becomes high to cause a valve of the thermostat to open, so that the coolant of high temperature flows into the radiator for the first time, or in a case of, what is called, hunting phenomenon such that the thermostat repeats opening and closing while driving in the cold region.

On the other hand, as shown in FIG. 10, as the tubes 102, flat tubes having partitions 104 inside, as disclosed in Japanese Patent Laid-open No. 2002-303496 for example, have become the mainstream in recent years. However, due to the partitions 104 formed inside, the flat tubes 102 have a small allowable amount of deformation against an external pressure, so that the alleviation of thermal stress of the seat plates 101 against the tubes 102 has been an urgent issue.

The present invention has been made in light of the above-described problems, and an object thereof is to provide a core structure of a heat exchanger which is capable of preventing a crack and a breakage of root portions of tubes fixed to seat plates due to thermal stress of the seat plates against the tubes when coolant flowing from an engine into a heat exchanger, such as a radiator, rapidly changes in temperature from low to high.

SUMMARY OF THE INVENTION

A core structure of a heat exchanger according to the present invention includes: tubes in which a heat exchange medium flows; tubes in which coolant flows; corrugated fins adhering to the tubes to advance radiation of heat from the tubes; and seat plates arranged opposite to each other with a predetermined space interposed therebetween and having the tubes and the corrugated fins arranged alternately therebetween, the seat plates being provided with connection portions having main body portions and wall portions slanted from the main body portions thereof toward the tubes and formed with tube holes through which the tubes are inserted to be fixed, wherein the connection portions have vulnerable portions which are formed thinner than the seat plates and in series on the wall portions and absorb thermal stress of the seat plates against the tubes by bending.

According to this core structure of the heat exchanger, even when a heat exchange medium, such as a coolant or a refrigerant, flowing from an engine into a heat exchanger rapidly changes in temperature from low to high and increases temperatures of seat plates and tubes to make them thermally expand, thermal stress of the seat plates against the tubes can be absorbed by bending of the vulnerable portions, so that cracking and/or breaking of the tubes can be avoided.

Further, preferably, the vulnerable portions are formed on at least one of positions between the main body portions and the wall portions and positions between the wall portions and the tube holes.

By forming the vulnerable portions which are thinner than the seat plates on at least one of the positions between the wall portions and the main body portions and the positions between the wall portions and the tube holes, even when coolant flowing from an engine into a heat exchanger rapidly changes in temperature from low to high and increases temperatures of seat plates and tubes to make them thermally expand, thermal stress of portions where the thermal stress of the seat plates against the tubes becomes large can be absorbed, so that cracking and/or breaking of the tubes can be avoided, and it becomes possible to easily form the wall portions and the vulnerable portions by burring or the like.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENT

Hereinafter, an embodiment of a core structure of a heat exchanger according to the present invention will be described with reference to the drawings.

Incidentally, in this embodiment, a case of applying the heat exchanger to an automotive radiator having flat tubes will be described.

Figure 1:
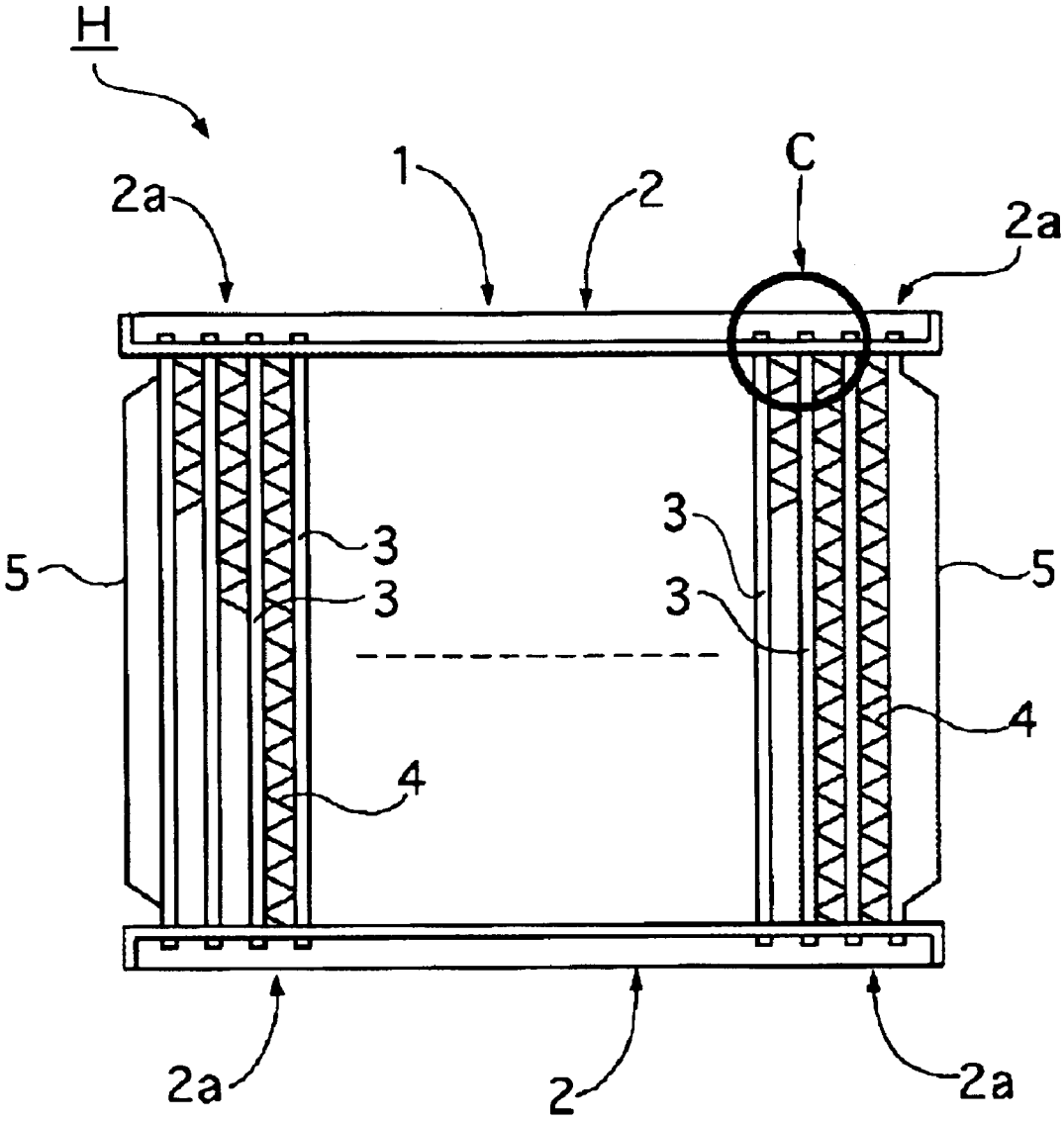
FIG. 1 is a front view showing an entire core structure of a heat exchanger according to an embodiment of the present invention.

As shown in FIG. 1, a core structure H of a heat exchanger of this embodiment constitutes a main portion of a radiator 1 and has a pair of seat plates 2 arranged opposite to each other at a top and bottom position.

Reinforcements 5 are arranged respectively at both side end portions 2*a* of the seat plates 2 and couple the top and bottom seat plates 2. Between the seat plates 2 and the reinforcements 5, tubes 3 and corrugated fins 4 are alternately arranged with a predetermined space interposed therebetween in a direction of the width of the radiator 1.

In the tubes 3, a coolant flows. The coolant functions as a heat exchange medium of the present invention.

Figure 2:
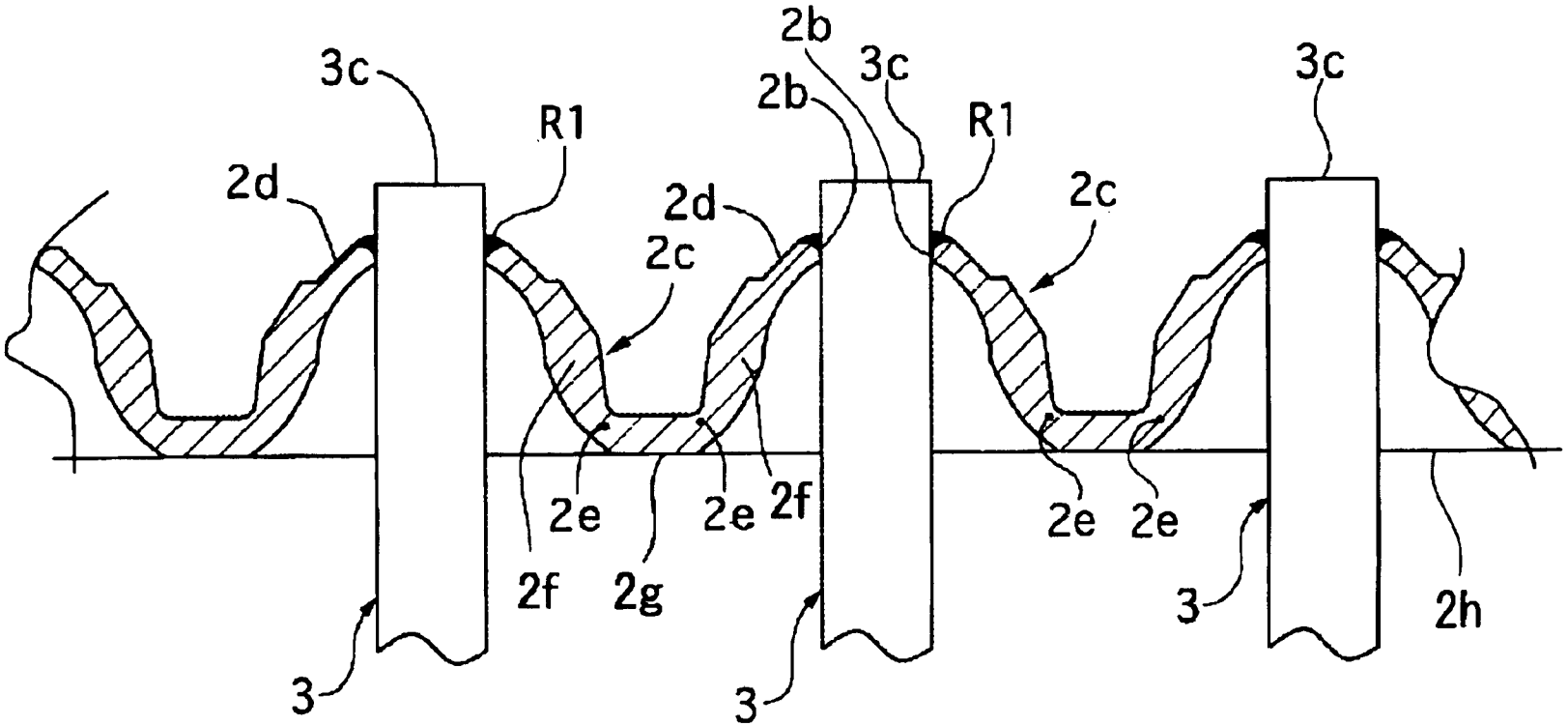
FIG. 2 is an enlarged cross-sectional side view showing connection portions of tubes and seat plates indicated by an arrow C in FIG. 1.
Figure 3:
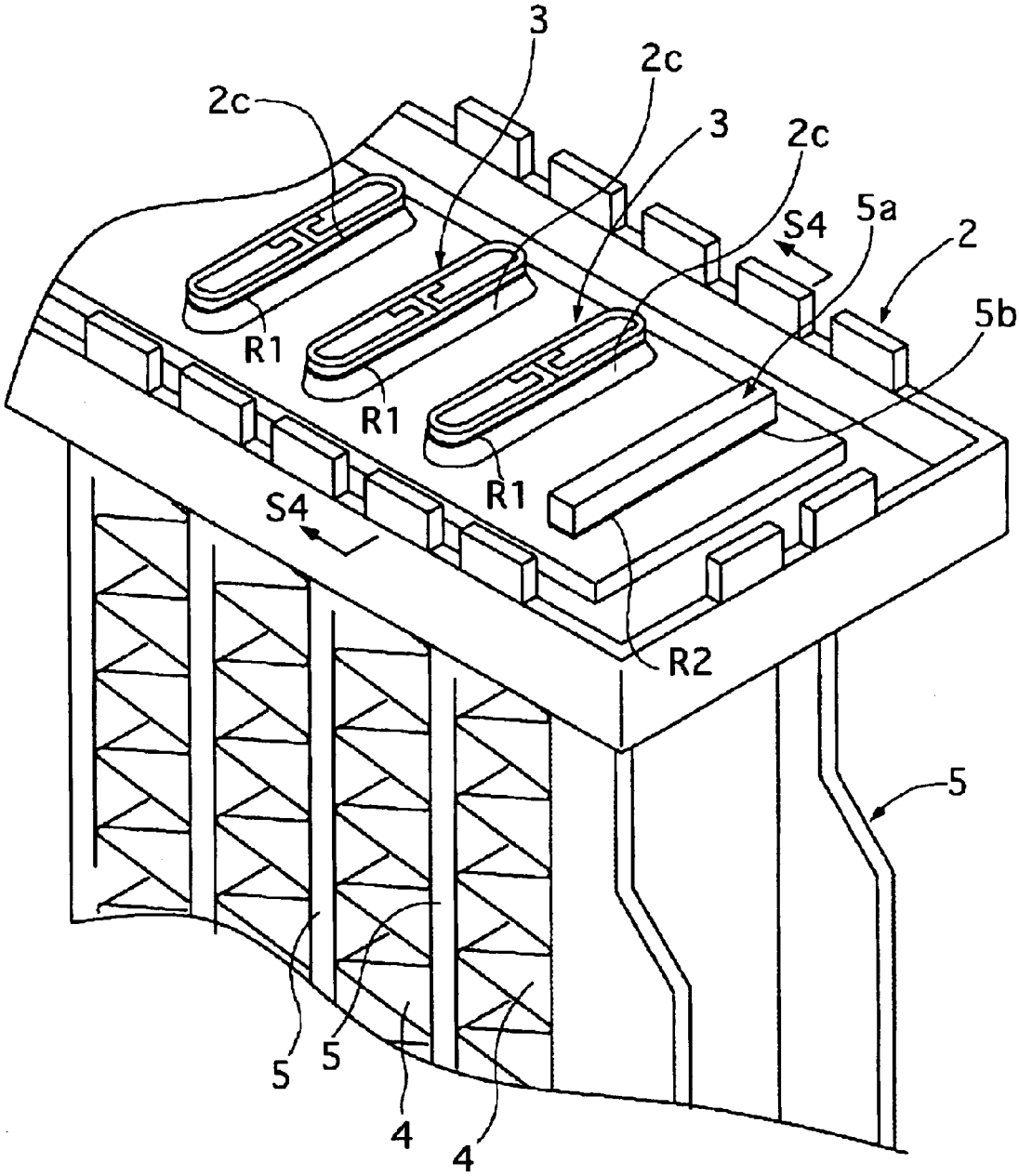
FIG. 3 is an enlarged perspective view of the seat plate on a top side.
Figure 4:
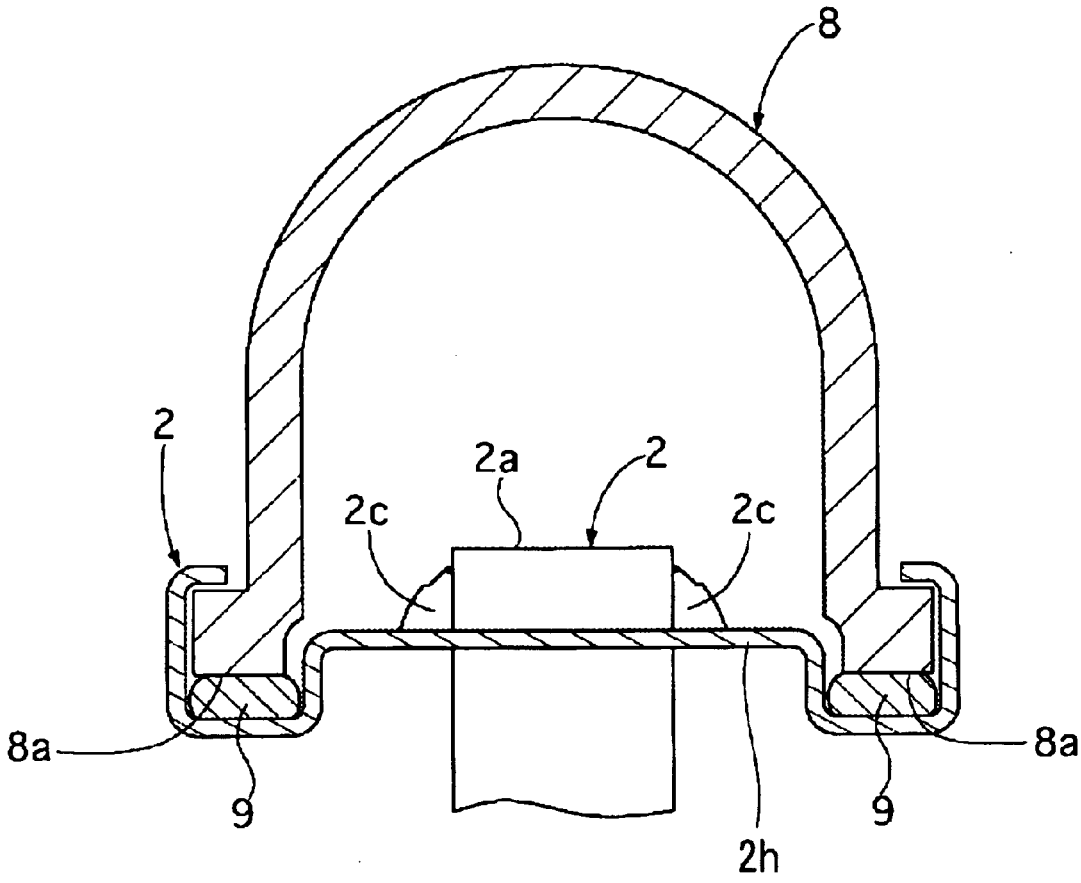
FIG. 4 is an enlarged cross-sectional view taken along S4 to S4 in FIG. 3.

As shown in FIG. 2 to FIG. 4, on each of main body portions 2*h* of the top and bottom seat plates 2, connection portions 2*c* having tube holes 2*b* formed therein are provided with a predetermined space, and the seat plates 2 and the tubes 3 are fixed by brazes R1 in a state that an upper and lower end portion 3*c* of the tubes 3 are inserted respectively through the tube holes 2*b* formed on the top and bottom seat plates 2.

In FIG. 2 to FIG. 4, only top side portions of the seat plates 2, the tubes 3, and so on are illustrated, and bottom side portions thereof are not shown. Regarding the bottom side portions, the bottom seat plate 2 and the lower end portions of the tubes 3 are fixed in a vertically reverse state of the upper side portions.

Further, as shown in FIG. 2, the connection portions 2*c* of the seat plate 2 have wall portions 2*f*, shaped in a cup figure projecting from a main body portion 2*h* to slant toward the tube 3, formed with tube holes 2*b* into which the tubes 3 are inserted from the inner side of the seat plate 2, and first vulnerable portions 2*d* on the top side of the wall portions 2*f*, and second vulnerable portions 2*e* on the bottom side of the wall portions 2*f*.

The wall portions 2*f* is connected in series at its one end side with a first vulnerable portions 2*d* and at its other end side with a second vulnerable portions 2*e*. These first and second vulnerable portions 2*d* and 2*e* are thinner than the wall portions 2*f* which have the substantially same thickness as the main body portions 2*h* of the seat plates 2 and are formed with the wall portions 2*f* simultaneously at the time of burring.

The adjacent connection portions 2*c* of the seat plate 2 are connected in series through bottom portions 2*g* that have the substantially same thickness as the main body portions 2*h*. The connection portions 2*c* is formed with tube holes 2*b* where the tubes 3 are inserted and fixed.

On the other hand, both end portions 5*a* of the reinforcements 5 are fixed by brazes R2, as its upper end portion being shown in FIG. 3, in a state that they are inserted through reinforcement holes 5*b* formed in the seat plates 2.

Referring to FIG. 4, on the outside of the seat plates 2, a tank 8 is arranged with seals 9 interposed therebetween, and its lower outer periphery portions 8*a* thereof are fixed to the seat plates 2 by caulking.

Further, in the core structure H of the heat exchanger of this embodiment, the seat plates 2, the tubes 3, the corrugated fins 4, and the reinforcements 5 are all made of aluminum and integrally assembled in advance, and thereafter they are brazed integrally in a heat treatment furnace, not shown.

Next, a forming method of the connection portions 2*c* with the first and second vulnerable portions 2*d* and 2*e* on the seat plate 2 will be described with reference to FIGS. 5A–5C.

Note that as a forming method of the connection portions 2*c* of the seat plate 2 used for the core structure H of the heat exchanger of this embodiment, there will be described a forming method in which a step of forming the tube holes 2*b* and a step of forming the first and second vulnerable portions 2*d* and 2*e* in the seat plates 2 are simultaneously performed. However, these steps may be performed in separate steps or by other forming methods.

Figure 5A:
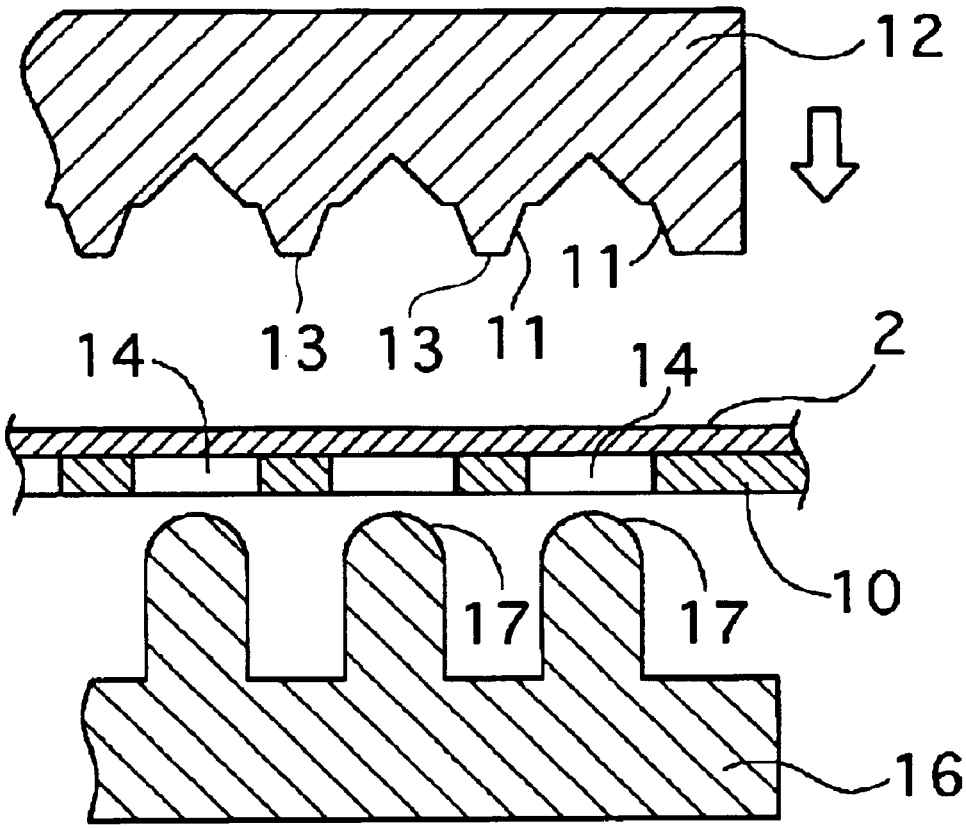
FIG. 5A is a view showing a manufacturing step before connection portions are formed on a seat plate.

As shown in FIG. 5A, first, a seat plate 2 is located on an ejector plate 10 which is biased by a spring, not shown, to be swingable in vertical directions.

Subsequently, a punch plate 12 on which punch chips 11 are formed with a predetermined space is moved down toward the seat plate 2 and comes in contact with its bottom portions 13 between the punch chips 11 and the seat plate 2. The seat plate 2 and the ejector plate 10 are pressed to move down with the punch plate 12 against the biasing force of the spring.

Figure 5B:
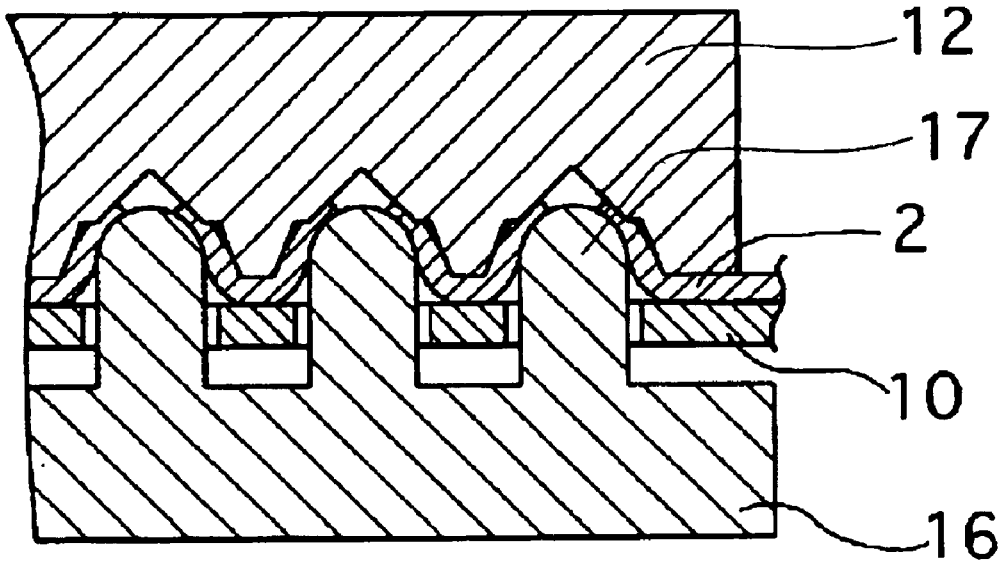
FIG. 5B is a view showing a manufacturing step of sandwiching the seat plate by a punch plate and a die plate to form the connection portions of the seat plate.

Next, as shown in FIG. 5B, when the bottom portions 13 of the punch plate 12 further move down in a state in contact with the seat plate 2, die chips 17 of a die plate 16 arranged below the ejector plate 10 protrude through openings 14 formed in the ejector plate 10 to penetrate and burr the seat plate 2.

Figure 5C:
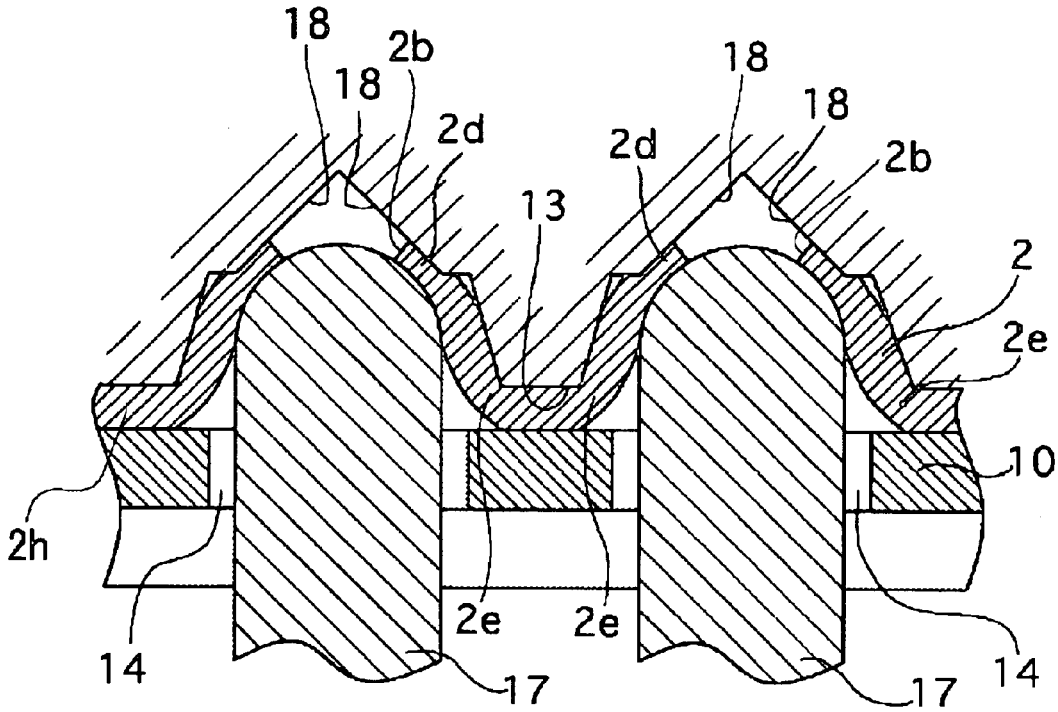
FIG. 5C is an enlarged cross-sectional view showing a part of the state in FIG. 5B.

At this time, as shown in enlargement in FIG. 5C, stepped portions 18 of the punch chips 11 and the die chips 17 crush the seat plate 2 to form the first vulnerable portions 2*d* on the top side and the tube holes 2*b*. At the same time, the bottom portions 13 of the punch plate 12 and the ejector plate 10 crush the seat plate 2 to form the second vulnerable portions 2*e* on the main body portion 2*h* side.

Figure 6:
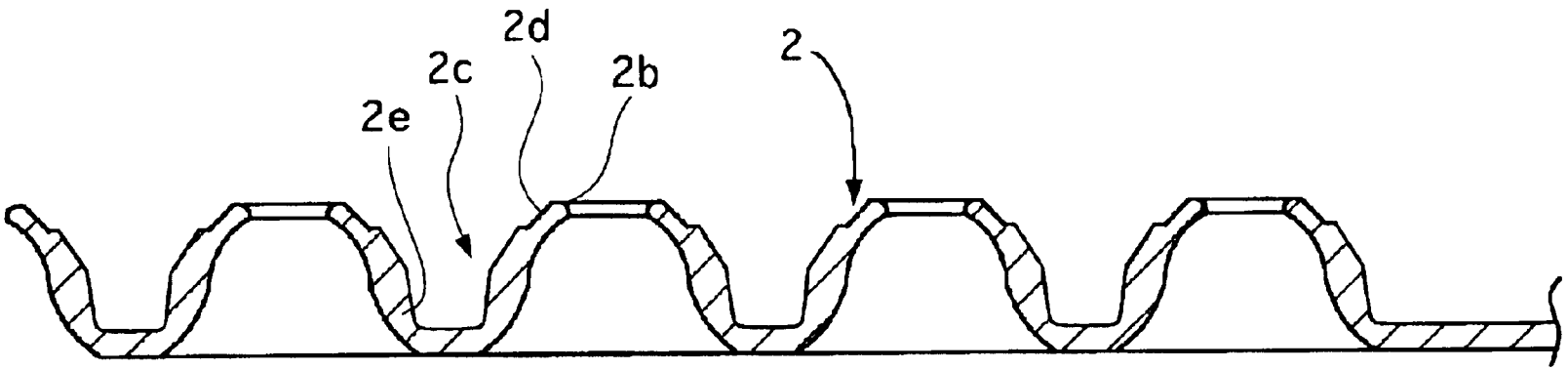
FIG. 6 is a cross-sectional view showing a shape of the seat plate in which the connection portions are formed by undergoing the manufacturing steps in FIG. 5A and FIG. 5B.

Finally, after the punch plate 12 is raised and returned to its original position, the seat plate 2 is removed from the ejector plate 10 to thereby obtain the seat plate 2 on which the connection portions 2*c* in desired shapes arranged with a predetermined space therebetween are formed as shown in FIG. 6.

Next, operation of the core structure H of the heat exchanger according to this embodiment will be described with reference to FIG. 7A and FIG. 7B.

In the core structure H of the heat exchanger of this embodiment, when a temperature of the coolant in the tank 8 increases high, temperatures of the seat plates 2 and the tubes 3 also increase, and then the seat plates 2 and tubes 3 expand thermally and largely.

Figure 7A:
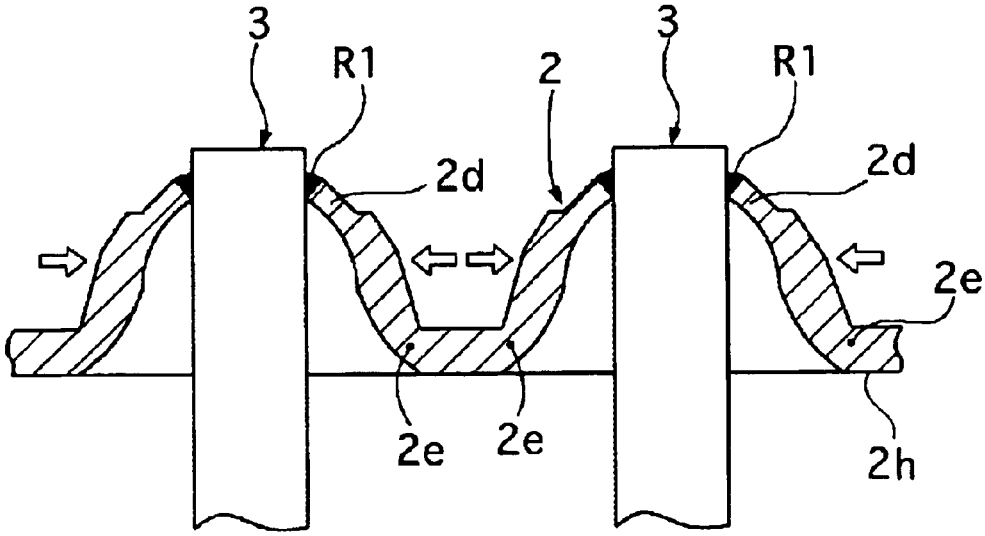
FIG. 7A is a partial cross-sectional view showing a state of tubes and the connection portions of the seat plate when a temperature of coolant is low.
Figure 7B:
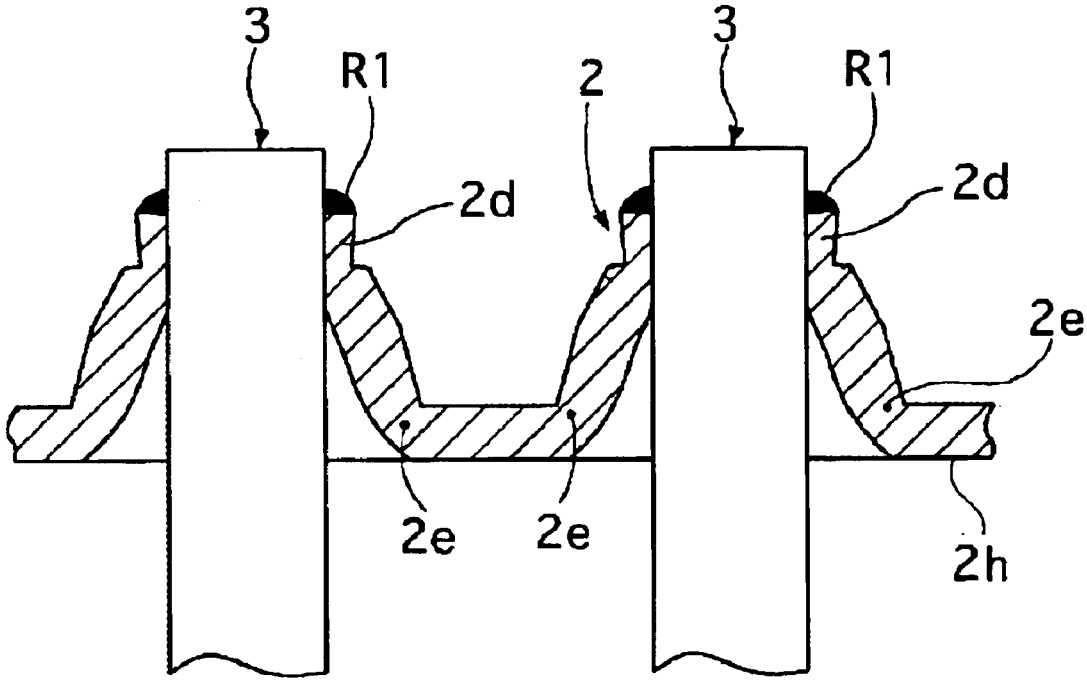
FIG. 7B is a partial cross-sectional view showing a state of the tubes and the connection portions of the seat plate when the temperature of coolant is high.
Figure 8:
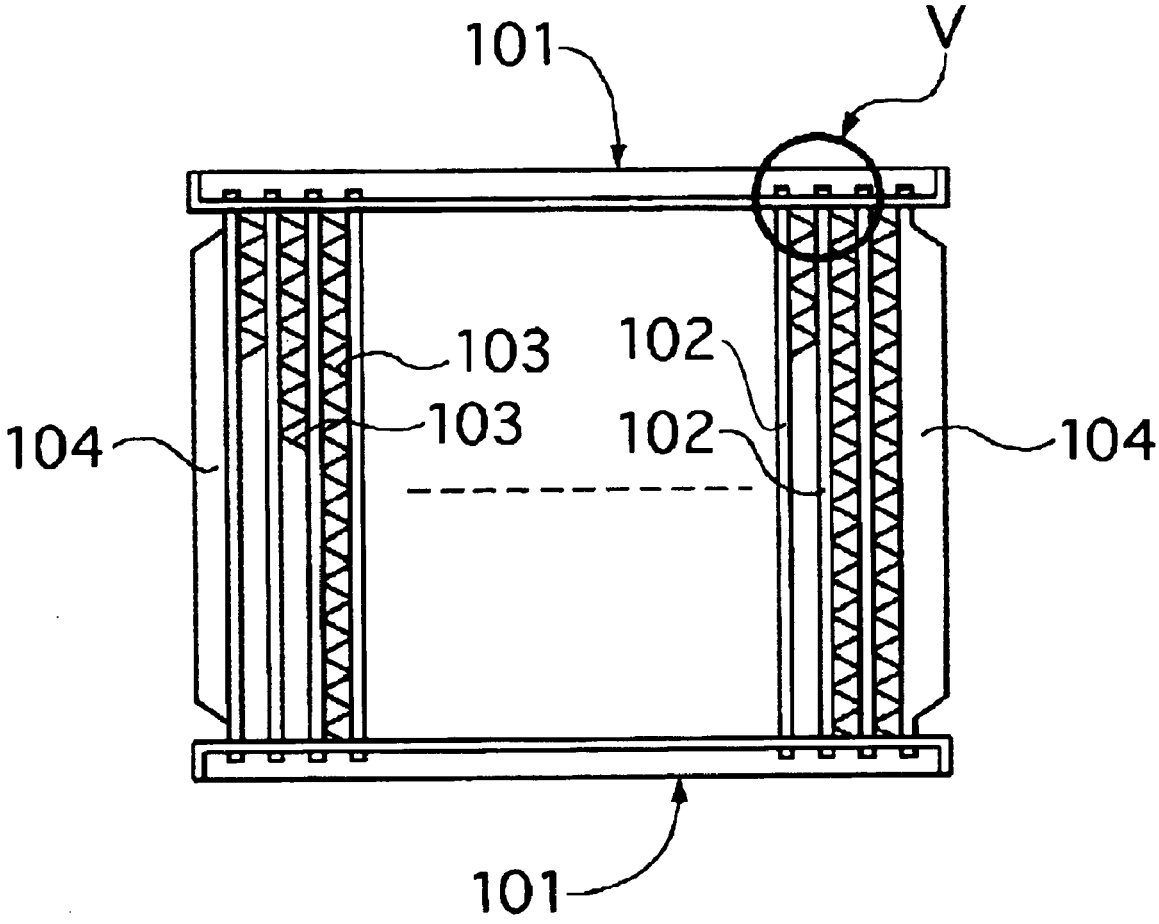
FIG. 8 is a front view showing a conventional entire core structure of a heat exchanger.
Figure 9:
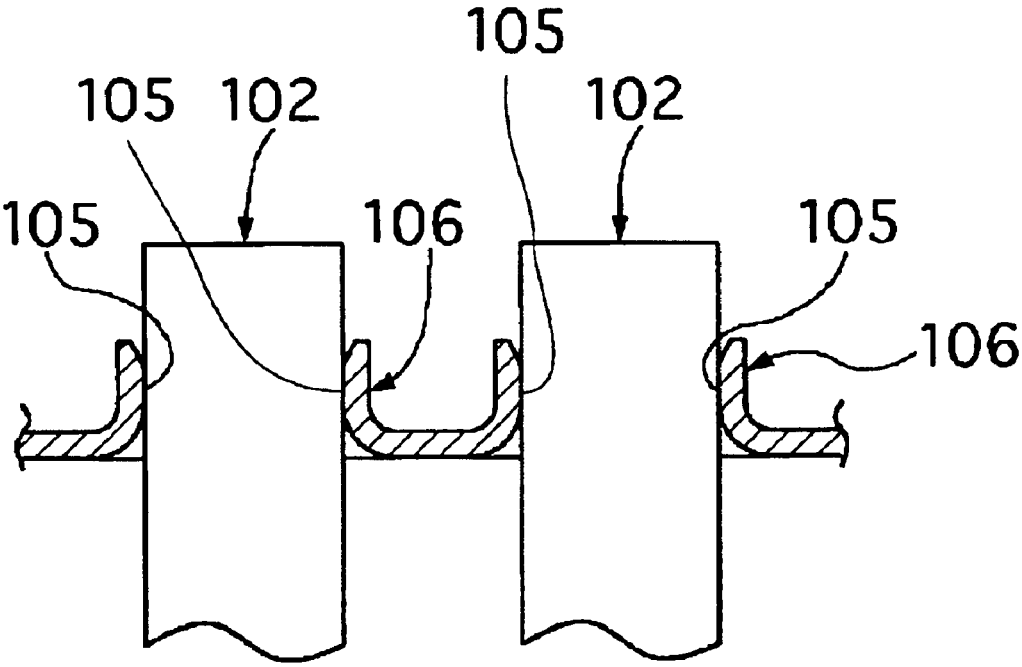
FIG. 9 is an enlarged view showing connection portions of tubes and a seat plate indicated by an arrow V in FIG. 8.
Figure 10:
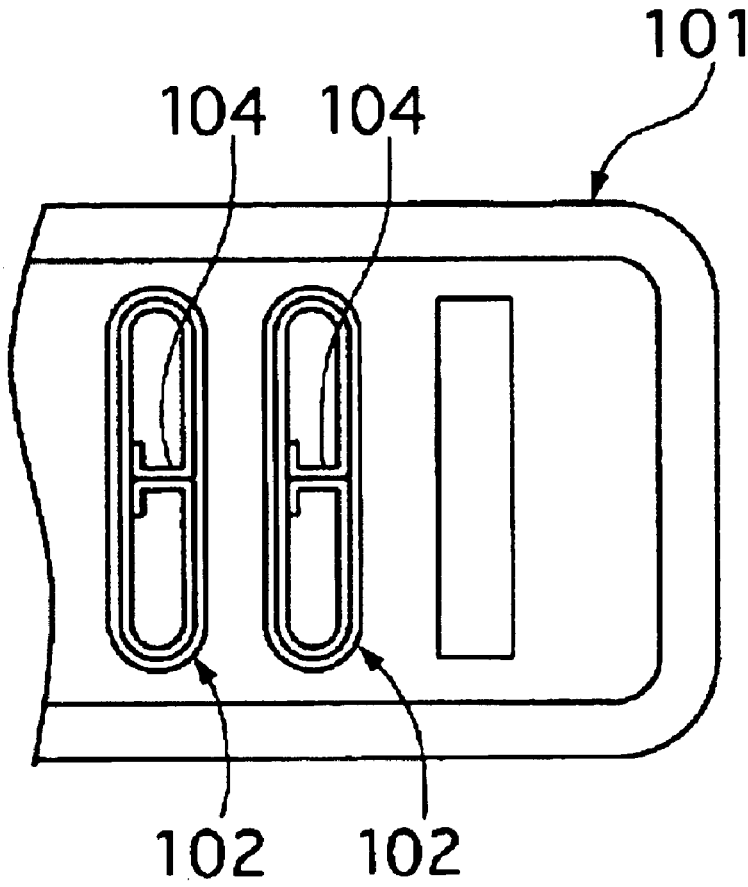
FIG. 10 is a plan view of another conventional core structure of a heat exchanger which has partitions in flat tubes.

At this time, as shown in FIG. 7A, thermal stress of the seat plates 2 affects to press the tubes 3 in directions of the arrows, but as shown in FIG. 7B, since the first and second vulnerable portions 2*d* and 2*e* of the connection portions 2*c* are thin in thickness, they easily bend to absorb the thermal stress so as to decrease the thermal stress affecting the tubes 3.

On the other hand, also when the temperature of coolant in the tank 8 changes from high to low, the first and second vulnerable portions 2*d* and 2*e* of the connection portions 2*c* appropriately bend to follow the tubes 3.

Therefore, according to the core structure H of the heat exchanger of this embodiment, since the first and second vulnerable portions 2*d* and 2*e* which easily bend are provided on the connection portions 2*c*, the thermal stress of the seat plates 2 against the tubes 3 can be absorbed by bending of the first and second vulnerable portions 2*d* and 2*e*, so that cracking and/or breaking of the tubes 3 can be avoided when the seat plates 2 and the tubes 3 increase in temperature and thermally expand.

Further, the core structure H of the heat exchanger of this embodiment is preferable for applying to flat tubes having a small allowable amount of deformation against an external pressure. It also may be applied to any tube regardless of its shape so as to achieve the same effects as those described above.

In the foregoing, the embodiment of the present invention has been described, but the specific structure of the present invention is not limited to this embodiment. The present invention includes any change of design in the range not departing from the gist of the invention.

For example, the number and the positions of vulnerable portions to be formed on the connection portions can be appropriately set.

Further, in this embodiment, the core structure applied to flat tubes is described, but it may be applied to other types of tubes.

The heat exchange medium of the present invention includes not only a coolant but also a refrigerant and the like.

The heat exchanger of the present invention includes not only a radiator, but also a condenser and the like.

What is claimed is:

1. A core structure of a heat exchanger, the core structure comprising:

a plurality of tubes through which a heat exchange medium is to flow;

a plurality of corrugated fins adhering to said tubes to advance radiation of heat from said tubes; and a plurality of seat plates arranged opposite to each other with a predetermined space interposed therebetween and having said tubes and said corrugated fins arranged alternately therebetween, said seat plates being provided with connection portions having main body portions and wall portions slanted from said main body portions toward said tubes and formed with tube holes through which said tubes are inserted to be fixed, wherein the connection portions also have first and second vulnerable portions which are thinner than said main body portions and said wall portions, in series on said wall portions, and absorb thermal stress of said seat plates against said tubes by bending, and said first and second vulnerable portions are formed at a position between said wall portions and the tube holes and a position between said main body portions and said wall portions, respectively.

2. A core structure of a heat exchanger according to claim 1, wherein the tube holes are positioned at a position further from said main body portions than said wall portions and said first and second vulnerable portions.

* * * * *